US008931538B2

(12) United States Patent
Ho et al.

(10) Patent No.: US 8,931,538 B2
(45) Date of Patent: Jan. 13, 2015

(54) VENETIAN BLIND AND OPERATING DEVICE THEREOF

(75) Inventors: Sung Chou Ho, Guangdong (CN); Dick Chen, Guangdong (CN)

(73) Assignee: Guangzhou Garden Rubber & Plastic Co., Ltd., Guangzhou, Guangdong (CN)

( * ) Notice: Subject to any disclaimer, the term of this patent is extended or adjusted under 35 U.S.C. 154(b) by 346 days.

(21) Appl. No.: 13/602,520

(22) Filed: Sep. 4, 2012

(65) Prior Publication Data

US 2013/0306253 A1 Nov. 21, 2013

(30) Foreign Application Priority Data

May 18, 2012 (CN) ..... 2012 2 0228148

(51) Int. Cl.
*E06B 9/30* (2006.01)
*E06B 9/36* (2006.01)
*E06B 9/324* (2006.01)

(52) U.S. Cl.
USPC ..... 160/168.1 R; 160/178.2

(58) Field of Classification Search
CPC ..... E06B 9/303; E06B 9/306; E06B 9/32; E06B 9/72
USPC ..... 160/168.1 R, 172 R, 173 R, 176.1 R, 160/177 R, 178.1 R, 177 V, 178.1, 178.2, 160/84.04; 16/428, 429, 426, 422, 110.1, 16/111.1; 188/65.1; 24/115 G, 122.3; 254/385
See application file for complete search history.

(56) References Cited

U.S. PATENT DOCUMENTS

| | | | | |
|---|---|---|---|---|
| 3,123,182 | A * | 3/1964 | Malone et al. | 188/65.1 |
| 5,464,775 | A * | 11/1995 | Smith | 436/63 |
| 5,671,793 | A * | 9/1997 | Lee | 160/168.1 R |
| 5,904,198 | A * | 5/1999 | Huang | 160/168.1 R |
| 6,189,595 | B1 * | 2/2001 | Lee | 160/168.1 R |
| 6,516,860 | B1 * | 2/2003 | Weaver et al. | 160/168.1 R |
| 7,337,503 | B1 | 3/2008 | Ashbrook | |
| 8,739,852 | B2 * | 6/2014 | Anderson et al. | 160/168.1 R |
| 2003/0201076 | A1 | 10/2003 | Nien | |
| 2008/0066876 | A1 * | 3/2008 | Ganzi | 160/168.1 R |
| 2011/0259534 | A1 | 10/2011 | Vestal et al. | |
| 2012/0305200 | A1 * | 12/2012 | Liu | 160/84.04 |

FOREIGN PATENT DOCUMENTS

EP 0666404 B1 1/1998

OTHER PUBLICATIONS

Australian Office Action dated Feb. 26, 2014; Australian Application No. 2012216468 (4 p.).

* cited by examiner

*Primary Examiner* — Katherine Mitchell
*Assistant Examiner* — Jeremy Ramsey
(74) *Attorney, Agent, or Firm* — Conley Rose, P.C.

(57) ABSTRACT

A venetian blind operating device comprises a wand having a center hole and a slide slot. The slide slot runs through the wand in an axial direction and intersects the center hole. In addition, the operating device comprises a blind cord locking assembly locked in the center hole of the wand and coupled to a blind cord of a venetian blind. Further, the operating device comprises a control key surroundingly provided at a periphery of the wand, and a press key provided on the control key for disengaging the blind cord locking assembly from a locked state. The blind cord is hidden by being contained in the center hole of the wand. The press key, the control key and the blind cord locking assembly are cooperated to withdraw or draw the venetian blind.

14 Claims, 9 Drawing Sheets

VENETIAN BLIND AND OPERATING DEVICE THEREOF

CROSS REFERENCE TO RELATED APPLICATIONS

The present application claims the benefit of priority to Chinese patent application No. 201220228148.7 titled "VENETIAN BLIND AND OPERATING DEVICE THEREOF", filed with the Chinese State Intellectual Property Office on May 18, 2012. The entire disclosures thereof are incorporated herein by reference.

STATEMENT REGARDING FEDERALLY SPONSORED RESEARCH OR DEVELOPMENT

Not applicable.

BACKGROUND

1. Field of the Invention

The present application relates to the technical field of the venetian blind, in particular, to a venetian blind and an operating device thereof 2. Background of the Technology The venetian blind is widely used all around the world, and is especially popular in Southeast Asia and European countries where the venetian blind has been used for a long time. In the housing decoration industry of China, the venetian blind is also a popular decorative product. The venetian blind gradually becomes an indispensable product used in the house or in the office in our daily life.

Currently, the venetian blind is operated via a blind cord or a blind string, i.e., the upward withdrawing and the downward drawing operations of the venetian blind are controlled by the blind cord or the blind string. If the person or the animal contacts the blind cord or the blind string, they may be caught in the blind cord or the blind string and unable to escape, and even may suffer life risk if they are unable to escape.

Therefore, a technical problem to be solved presently by those skilled in the art is to hide the blind cord to protect the person or the animal from suffering life risk due to an exposed cord.

SUMMARY OF THE DISCLOSURE

In view of this, it is provided according to the present application a venetian blind and an operating device thereof, to hide the blind cord, thereby to protect a person or an animal from suffering life risk due to an exposed blind cord.

In order to achieve the above object, it is provided according to the present application the following technical solutions:

A venetian blind operating device, including:

a wand having a center hole and a slide slot, the slide slot running through the wand in an axial direction and being communicated with the center hole;

a blind cord locking assembly locked in the center hole of the wand and coupled with a blind cord of a venetian blind;

a control key surroundingly provided at a periphery of the wand; and a press key provided on the control key for disengaging the blind cord locking assembly from a locked state.

Preferably, in the above venetian blind operating device, the blind cord locking assembly includes:

a locking sleeve provided in the center hole of the wand;

a ball-locking device slidably provided in the locking sleeve, wherein, balls of the ball-locking device, after popping out, can abut against an inner wall of the wand, and the press key is configured to drive the balls of the ball-locking device to be partially embedded in the locking sleeve;

a blind cord fixing device provided in the center hole of the wand; and an elastic restoring device, two ends of which being provided between the locking sleeve and the ball-locking device.

Preferably, in the above venetian blind operating device, the press key is coupled, via a buckle structure thereof, with a groove in the control key, and an extending length of the buckle structure is larger than a wall thickness of the groove of the control key.

Preferably, in the above venetian blind operating device, the press key is provided with inserting plates which are extended through the control key and the slide slot in the wand in turn, and are insertedly coupled in inserting grooves of the blind cord fixing device and the locking sleeve, respectively.

Preferably, in the above venetian blind operating device, the press key disengages the blind cord locking assembly from the locked state via a wedge-shaped pushing plate, wherein one end of the wedge-shaped pushing plate extends through the control key and the slide slot in the wand, and abuts, with an inclined surface thereon, against a top portion of the ball-locking device; the other end of the wedge-shaped pushing plate abuts against the press key; and the inclined surface of the wedge-shaped pushing plate is an inclined surface which inclines upwardly from one end of the inclined surface close to the press key to the other end of the inclined surface.

Preferably, in the above venetian blind operating device, the elastic restoring device is a compression spring.

Preferably, in the above venetian blind operating device, the blind cord fixing device includes:

a fixing device body provided with a cord winding groove; and two cord winding wheels arranged in the cord winding groove, wherein each cord winding wheel is provided with a cord winding annular groove in a circumferential direction of the cord winding wheel, and the blind cord passes through between the two cord winding wheels.

Preferably, in the above venetian blind operating device, a labor-saving spring provided in the wand is further included; and a bottom cover is provided at a bottom portion of the wand, wherein one end of the labor-saving spring is connected to the bottom cover, and the other end thereof is connected to a bottom portion of the locking sleeve.

Preferably, in the above venetian blind operating device, a plugging device is further provided for plugging the slide slot in the wand.

Preferably, in the above venetian blind operating device, a slide channel is provided in a sidewall at each side of the slide slot of the wand; and the plugging device is a rubber strip or a top, and two rubber strips or tops are slidably provided in the slide channels in the sidewalls at two sides of the slide slot, respectively.

Preferably, in the above venetian blind operating device, a slide channel is provided in a sidewall at each side of the slide slot of the wand; and the plugging device is a belt strip, wherein two sides of the belt strip are slidably provided in the slide channels in the sidewalls at two sides of the slide slot, respectively, and two ends of the belt strip are connected to an upper end and a lower end of the control key, respectively.

Preferably, the above venetian blind operating device further includes:

a universal joint provided at a top portion of the wand; and a steering control key connected to the universal joint, the steering control key being provided with a control gear for driving blades of the venetian blind to swing.

A venetian blind including a head rail, a bottom rail and blades arranged between the head rail and the bottom rail, and further including any one of the above described venetian blind operating devices for stacking or spreading the blades.

Preferably, in the above venetian blind, one end of the blind cord of the venetian blind is fixedly connected to the bottom rail; and the other end of the blind cord passes through blind cord holes in the blades, then passes through the head rail and extends in the blind cord locking assembly.

Preferably, the above venetian blind further includes a mesh ladder strip connecting the head rail and the bottom rail, wherein one end of the blind cord of the venetian blind is fixedly connected to the bottom rail; and the other end of the venetian blind cord passes through the mesh ladder strip, then passes through the head railhead rail and extends in the blind cord locking assembly.

Based on the above arrangements, in the venetian blind operating devices provided according to the present application, where it needs to operate the venetian blind, the press key on the wand is pressed, and after the press key is pressed, the blind cord locking assembly is disengaged from the locked state, such that the control key and the blind cord locking assembly can slide upwardly and downwardly, thereby the venetian blind can be withdrawn or drawn with the upward or downward sliding of the press key, the control key and the blind cord locking assembly. When stopping pushing the control key and at the same time releasing the press key, the blind cord locking assembly returns to its locked state, thereby the withdrawing or drawing of the venetian blind is stopped. In the present application, the blind cord is hidden by being contained in the center hole of the wand, and the press key, the control key and the blind cord locking assembly are cooperated to withdraw or draw the venetian blind, thereby can protect the person or the animal from suffering life risk due to an exposed blind cord.

BRIEF DESCRIPTION OF THE DRAWINGS

For clearly illustrating embodiments of the present application or technical solutions in the prior art, drawings referred to in the description of the embodiments or the prior art will be briefly explained hereinafter. Apparently, the drawings in the following description are only some embodiments of the present application, and the person skilled in the art may obtain other drawings based on these drawings without any creative efforts.

DETAILED DESCRIPTION OF THE PREFERRED EMBODIMENTS

It is provided according to the present application a venetian blind and an operating device thereof, which can hide the blind cord, and thus can protect the person or the animal from suffering life risk due to an exposed blind cord.

The technical solutions of the embodiments according to the present application will be described clearly and completely hereinafter in conjunction with the accompanying drawings. Apparently, the embodiments described hereinafter are merely a portion of the embodiments of the present application, rather than all of the embodiments. All other embodiments made by the person skilled in the art without any creative efforts and based on the embodiments in accordance with the present application, fall into the protective scope of the present application.

Figure 1:
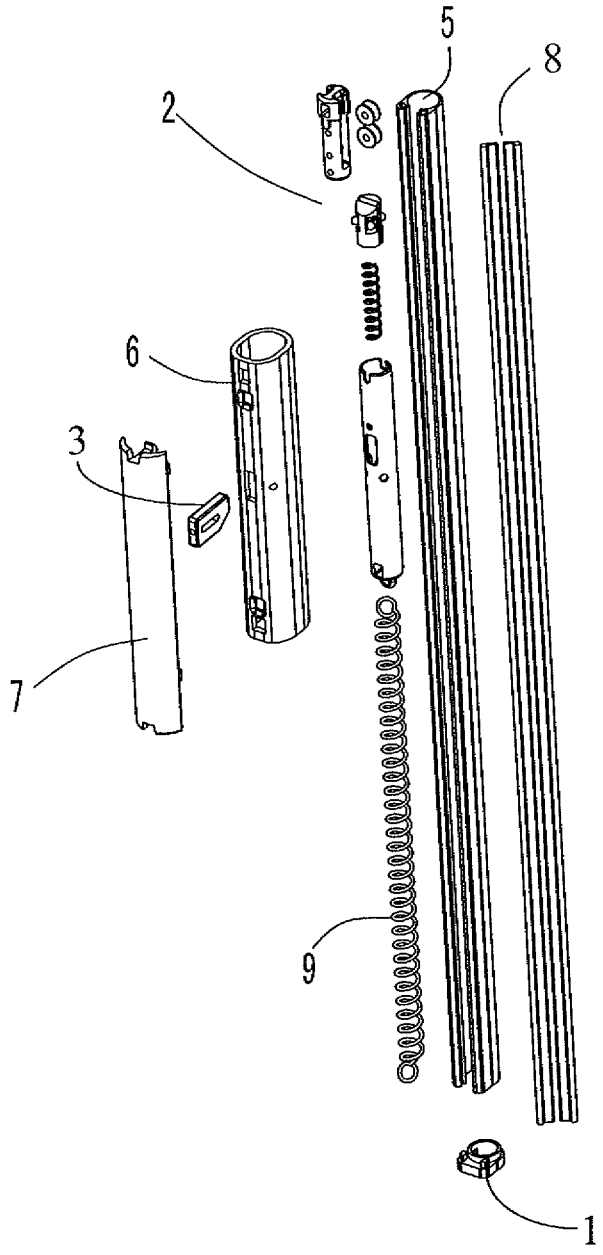
FIG. 1 is an exploded view of a venetian blind operating device according to an embodiment of the present application.
Figure 2:
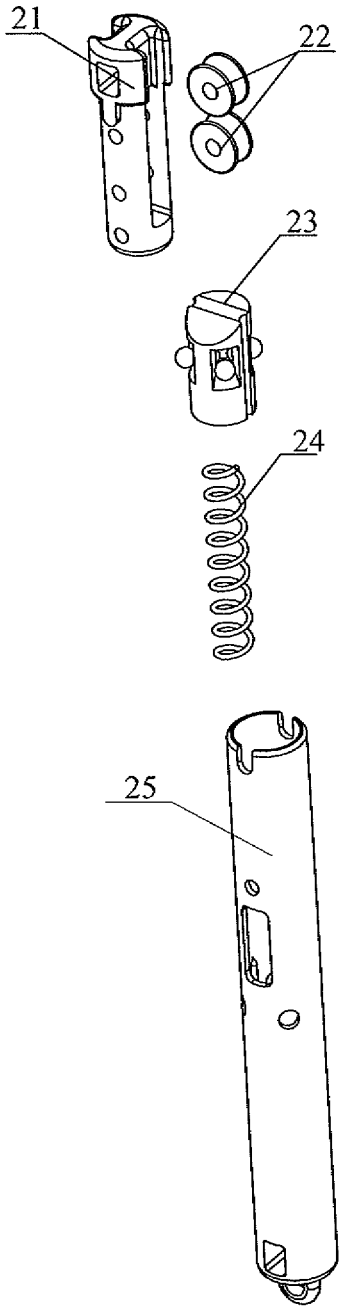
FIG. 2 is an exploded view of a blind cord locking assembly according to an embodiment of the present application.
Figure 3:
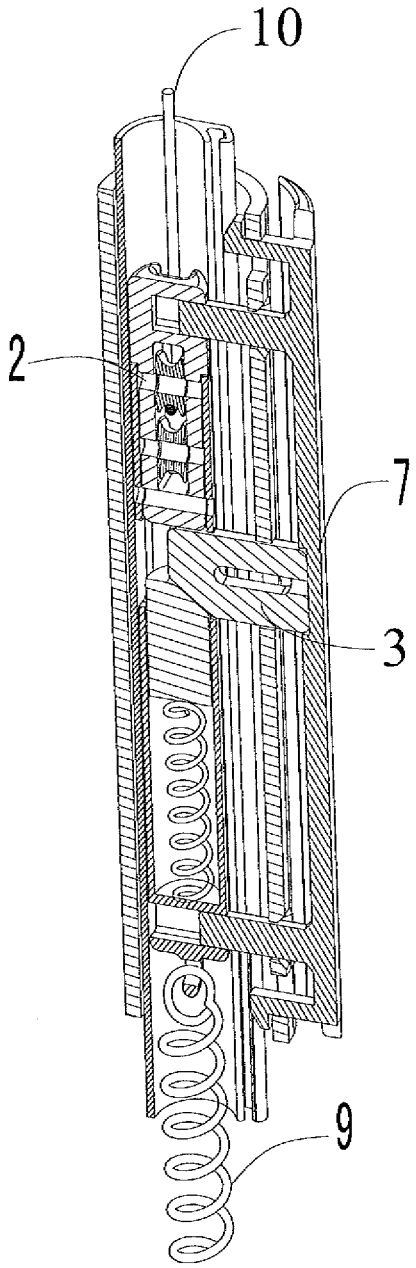
FIG. 3 is a partial sectional view of the venetian blind operating device according to the embodiment of the present application.
Figure 4:
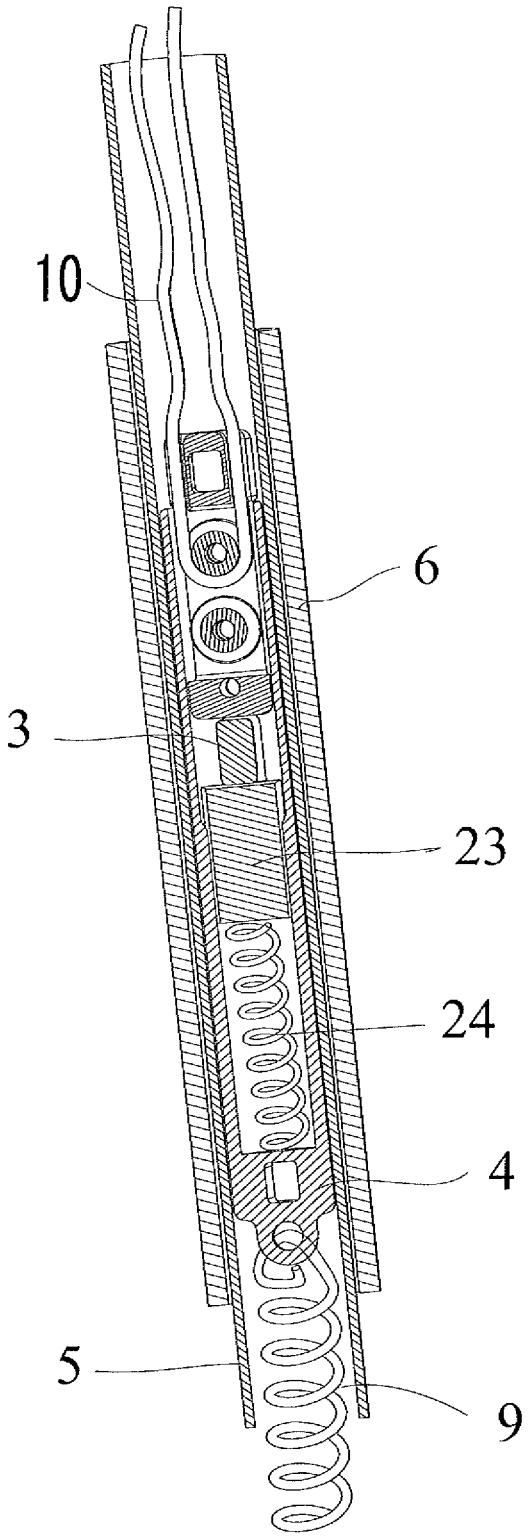
FIG. 4 is a partial sectional view of another cross section of the venetian blind operating device according to the embodiment of the present application.

Referring to FIGS. 1 to 4, FIG. 1 is an exploded view of a venetian blind operating device according to an embodiment of the present application; FIG. 2 is an exploded view of a blind cord locking assembly according to an embodiment of the present application; FIG. 3 is a partial sectional view of the venetian blind operating device according to the embodiment of the present application; and FIG. 4 is a partial sectional view of another cross section of the venetian blind operating device according to the embodiment of the present application.

The venetian blind operating device according to an embodiment of the present application includes a wand 5, a blind cord locking assembly 2, a control key 6 and a press key 7.

The wand 5 has a center hole and is provided with a slide slot running through the wand 5 in an axial direction of the wand and communicated with the center hole. The slide slot is mainly configured for the control key 6 and the press key 7 to slide upwardly and downwardly. The blind cord locking assembly 2 is locked in the center hole of the wand 5 and is coupled with a blind cord 10 of the venetian blind. Under normal state, the blind cord locking assembly 2 is locked in the wand 5, and can not be driven to slide in the center hole of the rotating hole 5 if the external force applied is small.

The control key 6 is surroundingly provided at the periphery of the wand 5. The press key 7 is provided on the control key 6 for disengaging the blind cord locking assembly 2 from being locked. According to the present application, the blind cord locking assembly 2 can be disengaged from being locked in the wand 5 if the press key 7 is pressed, thereby the blind cord locking assembly 2 can be driven to slide under a small external force, the blind cord locking assembly 2 in turn drives the blind cord 10 to move upwardly and downwardly, thereby realizing the withdrawing and drawing of the venetian blind.

According to the venetian blind operating device of the present application, where it needs to operate the venetian blind, the press key 7 on the wand 5 is pressed such that the blind cord locking assembly 2 is disengaged from being locked, thereby the control key 6 and the blind cord locking assembly 2 can be driven to slide upwardly and downwardly. The venetian blind can be withdrawn upwardly or drawn downwardly with the upward or downward sliding of the press key 7, the control key 6 and the blind cord locking assembly 2. When the pushing force applied to the control key 6 is stopped, and at the same time the press key 7 is released, the blind cord locking assembly 2 is locked again, thereby the withdrawing or drawing of the venetian blind is stopped. According to the present application, the blind cord 10 is hidden by being provided in the center hole of the wand 5, and the press key 7, the control key 6 and the blind cord locking assembly 2 are cooperated to withdraw or draw the venetian blind, thereby can protect the person or the animal from suffering life risk due to an exposed blind cord.

In the present embodiment, the blind cord locking assembly 2 includes a locking sleeve 25, a ball-locking device 23, a blind cord fixing device and an elastic restoring device 24. Preferably, the elastic restoring device 24 is a compression spring.

The locking sleeve 25 is provided in the center hole of the wand 5, and the ball-locking device 23 is slidably provided in the locking sleeve 25. Balls of the ball-locking device 23, after popping out, can abut against the inner wall of the wand 5. The press key 7 is configured to drive the balls of the ball-locking device 23 to be partially embedded in the locking sleeve 25. The blind cord fixing device for fixing the blind cord 10 is provided in the center hole of the wand 5. Two ends of the elastic restoring device 24 are positioned between the locking sleeve 25 and the ball-locking device 23.

Under normal state, the ball-locking device 23 is supported by the elastic restoring device 24 such that the balls of the ball-locking device 23 can partially protrude out of the locking sleeve 25 and abut against the inner wall of the wand 5, thereby the blind cord locking assembly 2 is in a locked state under the friction force and can not move upwardly or downwardly. Where it needs to drive the blind cord locking assembly 2 to slide upwardly or downwardly, the press key 7 is pressed to press the ball-locking device 23 in the locking sleeve 25, such that the balls of the ball-locking device 23 are disengaged from the inner wall of the wand 5, thereby the blind cord locking assembly 2 can slide.

As shown in FIG. 3, in the present embodiment, the press key 7 is coupled, via a buckle structure thereof, with a groove in the control key 6, and an extending length of the buckle structure is larger than a wall thickness of the groove in the control key 6. The buckle structure is configured such that the press key 7 can not disengage from the control key 6, and the extending length of the buckle structure is configured to be larger than the wall thickness of the groove in the control key 6 such that the press key 7 can be pressed with a certain displacement, thereby ensuring that the ball-locking device 23 can be pressed in the locking sleeve 25 so as to disengage the balls of the ball-locking device 23 from the inner wall of the wand 25.

The press key 7 is provided with inserting plates which are extended through the control key 6 and the slide slot in the wand 5 in turn, and are insertedly coupled in inserting grooves in the blind cord fixing device and the locking sleeve 25, respectively. After the inserting plates are inserted in the inserting grooves in the blind cord fixing device and the locking sleeve 25, the control key 6, the press key 7 and the blind cord locking assembly 2 are connected, thus the blind cord locking assembly 2 can be moved by pushing the control key 6, and accordingly the blind cord 10 can be moved.

In the present embodiment, the press key 7 disengages the blind cord locking assembly 2 from the locked state via a wedge-shaped pushing plate 3. One end of the wedge-shaped pushing plate 3 extends through the control key 6 and the slide slot in the wand 5, and abuts, with an inclined surface thereon, against a top portion of the ball-locking device 23, and the other end of the wedge-shaped pushing plate 3 abuts against the press key 7. The inclined surface of the wedge-shaped pushing plate 3 is an inclined surface inclining upwardly from one end of the inclined surface close to the press key 7 to the other end of the inclined surface.

Where the press key 7 is pressed, the inserting plates of the press key 7 are inserted in the inserting grooves in the blind cord fixing device and the locking sleeve 25, such that the control key 6, the press key 7 and the blind cord locking assembly 2 are connected, and accordingly the wedge-shaped pushing plate 3 is pushed to move. During the moving of the wedge-shaped pushing plate, the inclined surface of the wedge-shaped pushing plate 3 abuts against the top portion of the ball-locking device 23 and presses the ball-locking device 23 downwardly with the moving of the wedge-shaped pushing plate. Where the press key 7 is released, the press key 7 returns to its original state under the action of the elastic restoring device 24.

As shown in FIG. 2, in the present embodiment, the blind cord fixing device includes a fixing device body 21 and cord winding wheels 22.

The fixing device body 21 is provided with a cord winding groove, in which two cord winding wheels 22 are arranged. Each cord winding wheel 22 is provided with a cord winding annular groove in a circumferential direction of the cord winding wheel 22. The blind cord 10 passes through the two cord winding wheels 22.

In the case that the venetian blind is heavy, that is, the withdrawing resistance is large, the present application may further include a labor-saving spring 9 provided in the wand 5. A bottom cover 1 is provided at a bottom portion of the wand 5. One end of the labor-saving spring 9 is connected to the bottom cover 1, and the other end thereof is connected to a bottom portion of the locking sleeve 25.

Where withdrawing the venetian blind, the press key 7 is pressed and the control key 6 is pushed downwardly, and the labor-saving spring 9 automatically retracts downwardly and drives the control key 6 to move downwardly, thereby can save labor during the withdrawing operation. Where drawing the venetian blind, the press key 7 is pressed and the control key 6 is pushed upwardly, meanwhile the weight of the venetian blind is expanded downwardly, the labor-saving spring 9 is stretched upwardly, thereby can prevent the venetian blind from sliding down rapidly.

For further improving the above technical solution, the present application may further include a plugging device for plugging the slide slot in the wand 5. In the present application, an open portion of the slide slot is plugged by the plugging device, thus the blind cord is plugged and hidden in the wand, which improves the aesthetic perception of the device.

Figure 5:
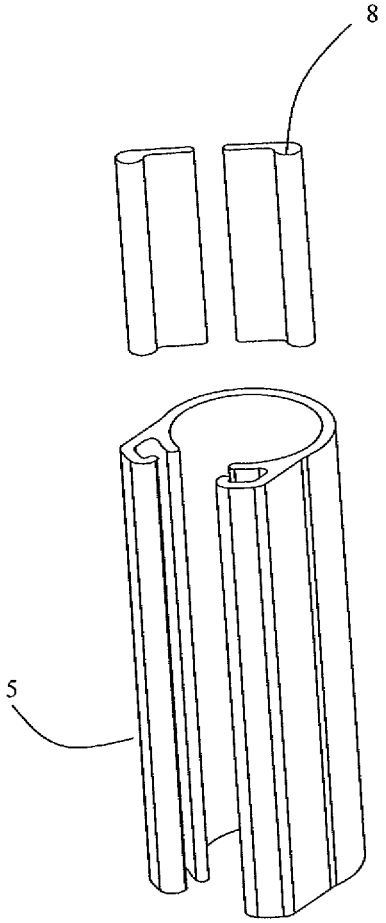
FIG. 5 is an exploded view of a wand and a rubber strip according to an embodiment of the present application.

Referring to FIG. 5, FIG. 5 is an exploded view of a wand and a rubber strip according to an embodiment of the present application.

In the present embodiment, a slide channel is provided in the sidewall at each side of the slide slot of the wand 5. The plugging device are rubber strips 8, and two rubber strips 8 are slidably provided in the slide channels in the sidewalls of the slide slot, respectively. A gap may be formed between the two rubber strips 8, or no gap is formed. Since the rubber strip has plasticity and can be deformed under an external force, thereby ensuring that the inserting plates of the press key 7 can slide freely.

Figure 6:
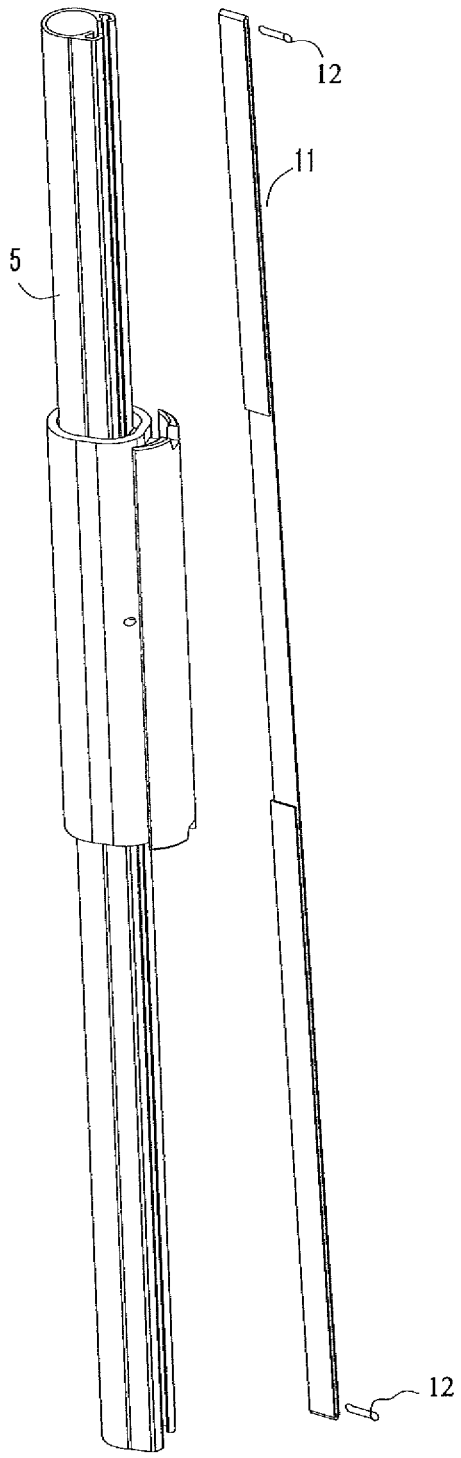
FIG. 6 is an exploded view of a wand and a belt strip according to an embodiment of the present application.

Referring to FIG. 6, FIG. 6 is an exploded view of a wand and a belt strip according to an embodiment of the present application.

In the present embodiment, a slide channel is provided in the sidewall at each side of the slide slot of the wand 5, and the plugging device is a belt strip 11. Two sides of the belt strip 11 are slidably cooperated in the slide channels in the sidewalls of the slide slot, respectively, and two ends of the belt strip 11 are connected to an upper end and a lower end of the control key 6, respectively. The control key 6 and the belt strip 11 form an annular structure, thus during the upward and downward moving of the control key 6, the slide slot, except for the portion where the control key 6 is located, is plugged by the belt strip 11.

In order that the belt strip 11 can slide smoothly, an upper end and a lower end of the wand 5 are respectively provided with a rotary shaft 12. The belt strip 11 is wound round the rotary shafts 12 and is slidably cooperated in the slide channels in the sidewalls of the slide slot.

Figure 7:
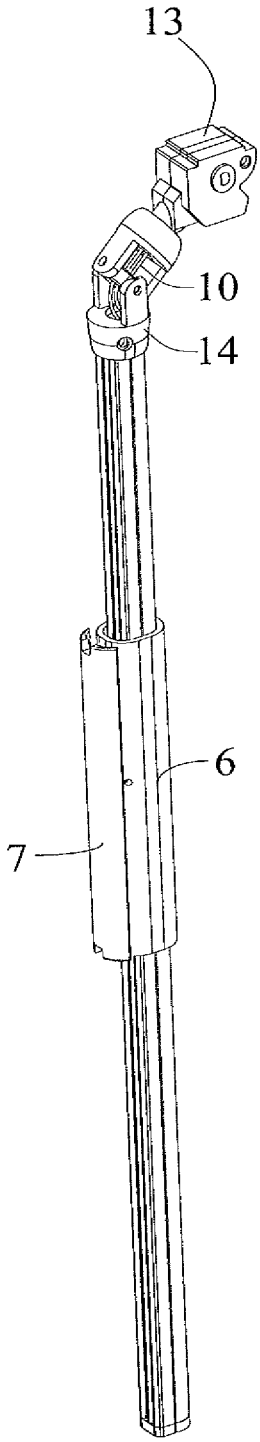
FIG. 7 is a structural schematic view of the venetian blind operating device according to the embodiment of the present application.

Referring to FIG. 7, FIG. 7 is a structural schematic view of the venetian blind operating device according to the embodiment of the present application.

For further improving the above technical solution, the present application may further include a universal joint 14 and a steering control key 13. The universal joint 14 is provided at a top portion of the wand 5, and the steering control key 13 is connected to the universal joint 14. The steering control key 13 is provided with a control gear for driving blades of the venetian blind to swing. The blind cord 10 extends out of the top portion of the wand 5 and passes through the universal joint 14 and the steering control key 13.

Figure 8:
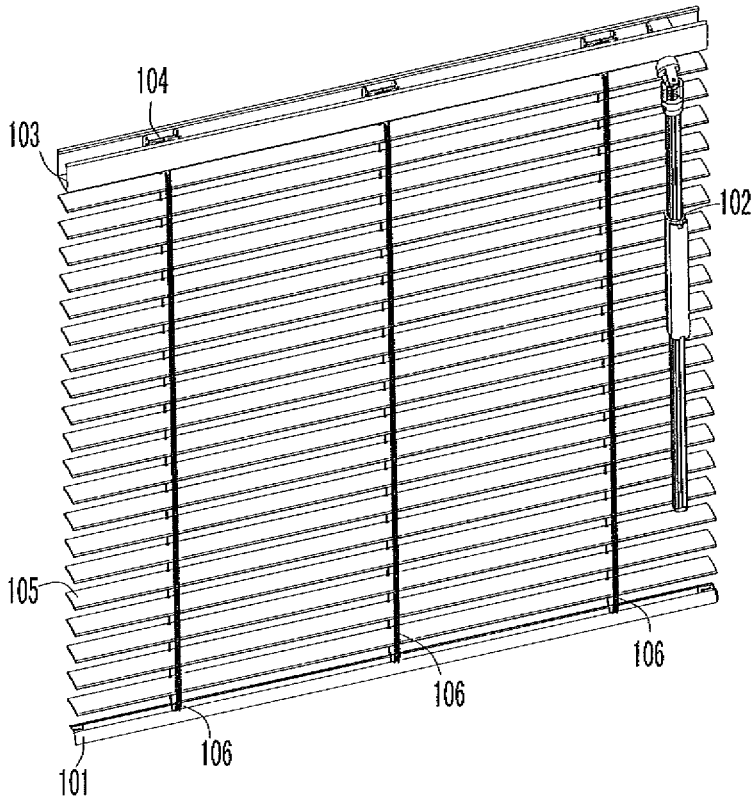
FIG. 8 is a structural schematic view of a venetian blind according to an embodiment of the present application.
Figure 9:
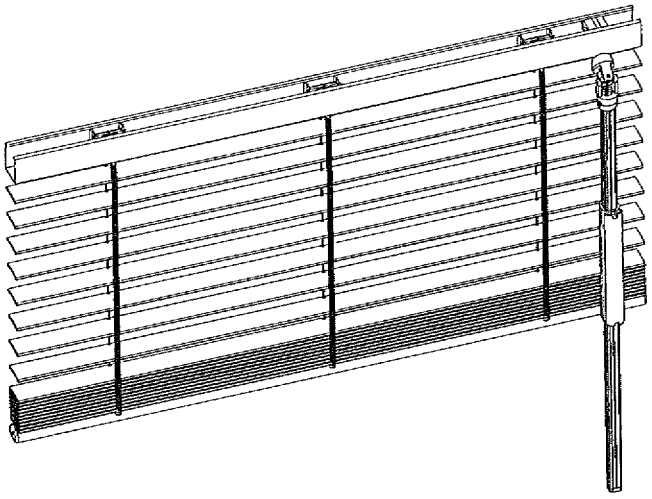
FIG. 9 is a structural schematic view of the venetian blind during a withdrawing process according to the embodiment of the present application.
Figure 10:
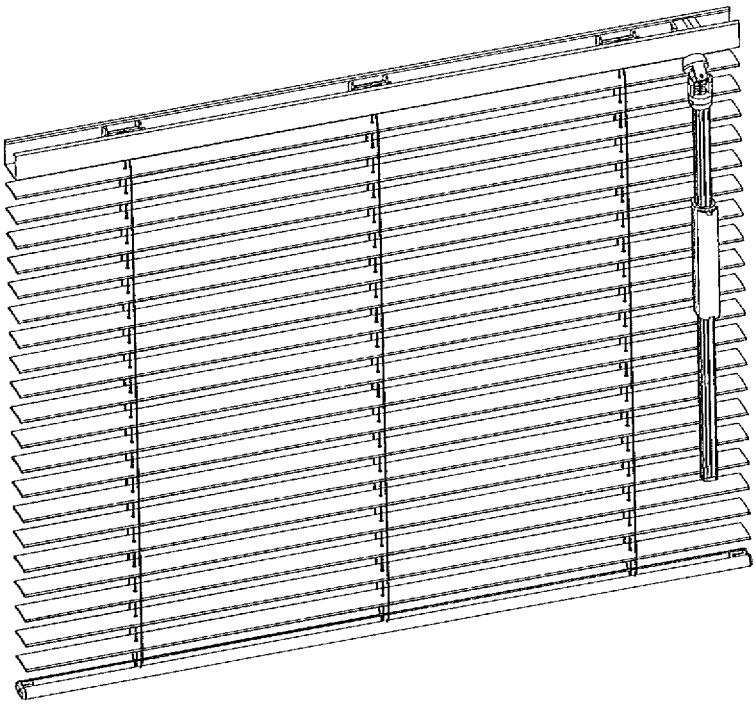
FIG. 10 is a structural schematic view of the venetian blind according to another embodiment of the present application.

Referring to FIGS. 8 to 10, FIG. 8 is a structural schematic view of a venetian blind according to an embodiment of the present application; FIG. 9 is a structural schematic view of the venetian blind during a withdrawing process according to the embodiment of the present application; and FIG. 10 is a structural schematic view of the venetian blind according to another embodiment of the present application.

The venetian blind according to an embodiment of the present application includes a head rail 103, a bottom rail 101 and blades 105 arranged between the head rail 103 and the bottom rail 101. The key factor of the present application lies in that a venetian blind operating device 102 as is described in the above embodiments is further included for stacking or spreading the blades 105.

Since the venetian blind according to the embodiment of the present application includes the venetian blind operating device 102 as is described in the above embodiments, the venetian blind has all the advantageous effects of the venetian blind operating device 102 described above, and thus will not be described herein.

One end of the blind cord 10 of the venetian blind is fixedly connected to the bottom rail 101, and the other end thereof passes through blind cord holes in the blades 105, and then passes through the head rail 103 and extends in the blind cord locking assembly 2. In detail, the blind cord enters the blind cord locking assembly 2 via a steering controller provided on the head rail 103.

Where it needs to adjust the venetian blind to allow light to pass through or to shade light (i.e., the swing of the blades of the venetian blind), the wand of the blind cord locking assembly 2 is rotated to drive the steering controller assembled in the head rail, then a control gear of the steering controller drives a driving shaft assembled in the head rail 103, thereby the venetian blind can be adjusted to allow light to pass through or to shade light (i.e., the blades of the venetian blind can be swung to allow light to pass through or to shade light).

The present application may further include a mesh ladder strip 106 connecting the head rail 103 and the bottom rail 101. One end of the blind cord 10 of the venetian blind is fixedly connected to the bottom rail 101, and the other end thereof passes through the mesh ladder strip 106, and then passes through the head rail 103 and extends in the blind cord locking assembly 2.

The blind cord is completely hidden in the mesh ladder strip 106 and the wand. Where it requires the venetian blind to shade light, a better shading effect and an improved safety are provided. By hiding the blind cord in the blades and the wand, where all of the blades 105 are stacked, the blades 105 are compactly overlapped.

The embodiments in the present description are described in a progressive way, and each embodiment is described by mainly describing the differences, thus cross references may be made among the embodiments having the same or similar parts.

Based on the description of the above embodiments, the person skilled in the art can perform or utilize the present application. It is apparent for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

What is claimed is:

1. A venetian blind operating device, comprising:

a wand having a center hole and a slide slot, the slide slot running through the wand in an axial direction and being communicated with the center hole;

a blind cord locking assembly locked in the center hole of the wand and coupled to a blind cord of a venetian blind;

a control key surroundingly provided at a periphery of the wand; and a press key provided on the control key for disengaging the blind cord locking assembly from a locked state; wherein the blind cord locking assembly comprises:

a locking sleeve provided in the center hole of the wand;

a ball-locking device slidably provided in the locking sleeve, wherein, balls of the ball-locking device, after popping out, can abut against an inner wall of the wand, and the press key is configured to drive the balls of the ball-locking device to be partially embedded in the locking sleeve;

a blind cord fixing device provided in the center hole of the wand; and an elastic restoring device, two ends of which being provided between the locking sleeve and the ball-locking device.

2. The venetian blind operating device according to claim 1, wherein the press key is coupled, via a buckle structure thereof, with a groove in the control key, and an extending length of the buckle structure is larger than a wall thickness of the groove in the control key.

3. The venetian blind operating device according to claim 2, wherein the press key is provided with at least one inserting plate extended through the control key and the slide slot in the wand in turn, and are insertedly coupled in inserting grooves of the blind cord fixing device and the locking sleeve, respectively.

4. The venetian blind operating device according to claim 3, wherein the press key disengages the blind cord locking assembly from the locked state via a wedge-shaped pushing plate, wherein one end of the wedge-shaped pushing plate extends through the control key and the slide slot in the wand, and abuts, with an inclined surface thereon, against a top portion of the ball-locking device; the other end of the wedge-shaped pushing plate abuts against the press key; and the inclined surface of the wedge-shaped pushing plate is an inclined surface which inclines upwardly from one end of the inclined surface close to the press key to the other end the inclined surface.

5. The venetian blind operating device according to claim 1, wherein the elastic restoring device is a compression spring.

6. The venetian blind operating device according to claim 1, wherein the blind cord fixing device comprises:

a fixing device body provided with a cord winding groove; and a plurality of cord winding wheels arranged in the cord winding groove, wherein each cord winding wheel is provided with a cord winding annular groove in a circumferential direction, and the blind cord passes through two of the plurality of cord winding wheels.

7. The venetian blind operating device according to claim 1, wherein the venetian blind operating device further comprises:

a labor-saving spring provided in the wand; and a bottom cover provided at a bottom portion of the wand, wherein one end of the labor-saving spring is connected to the bottom cover, and the other end thereof is connected to a bottom portion of the locking sleeve.

8. The venetian blind operating device according to claim 1, wherein the venetian blind operating device further comprises a plugging device for plugging the slide slot in the wand.

9. The venetian blind operating device according to claim 8, wherein a slide channel is provided in a sidewall at each side of the slide slot of the wand; and the plugging device is a rubber strip or a top, and the rubber strip or top is slidably provided in the slide channels in the sidewalls of the slide slot, respectively.

10. The venetian blind operating device according to claim 8, wherein a slide channel is provided in a sidewall at each side of the slide slot of the wand; and the plugging device is a belt strip having two sides, wherein the two sides of the belt strip are slidably provided in the slide channels in the sidewalls of the slide slot, respectively, and two ends of the belt strip are connected to an upper end and a lower end of the control key, respectively.

11. The venetian blind operating device according to claim 1, wherein the venetian blind operating device further comprises:

a universal joint provided at a top portion of the wand; and a steering control key connected to the universal joint, the steering control key being provided with a control gear for driving blades of the venetian blind to swing.

12. A venetian blind comprising:

a head rail;

a bottom rail;

a plurality of blades arranged between the head rail and the bottom rail; and a venetian blind operating device according to claim 1 configured to stack or spread the blades.

13. The venetian blind according to claim 12, wherein the blind cord has a first end and a second end, and wherein the first end is fixedly connected to the bottom rail, and the second end passes through a blind cord hole in each of the plurality of blades, then passes through the head rail, and extends in the blind cord locking assembly.

14. The venetian blind according to claim 12, further comprising a mesh ladder strip connecting the head rail and the bottom rail, wherein the blind chord has a first end and a second end, and wherein the first end of the blind cord is fixedly connected to the bottom rail, and the second end of the venetian blind cord passes through the mesh ladder strip, then passes through the head rail and extends in the blind cord locking assembly.

* * * * *